US010539378B2

(12) United States Patent
Diffey et al.

(10) Patent No.: US 10,539,378 B2
(45) Date of Patent: Jan. 21, 2020

(54) HEAT EXCHANGER

(71) Applicant: HS Marston Aerospace Limited, Staffordshire (GB)

(72) Inventors: Jacob Diffey, London (GB); John Marsh, Wolverhampton (GB); James Green, Worcestershire (GB); Chris McNab, Staffordshire (GB)

(73) Assignee: HS MARSTON AEROSPACE LTD., Staffordshire (GB)

( * ) Notice: Subject to any disclaimer, the term of this patent is extended or adjusted under 35 U.S.C. 154(b) by 0 days.

(21) Appl. No.: 15/730,782

(22) Filed: Oct. 12, 2017

(65) Prior Publication Data

US 2018/0106561 A1 Apr. 19, 2018

(30) Foreign Application Priority Data

Oct. 13, 2016 (EP) ..... 16193635

(51) Int. Cl.
*F28F 13/12* (2006.01)
*F28F 9/02* (2006.01)

(52) U.S. Cl.
CPC ..... *F28F 13/125* (2013.01); *F28F 9/028* (2013.01); *F28F 9/0265* (2013.01); *F28F 9/0268* (2013.01); *F28F 2250/02* (2013.01)

(58) Field of Classification Search
CPC ..... F28F 9/026; F28F 9/0265; F28F 9/0268; F28F 9/028; F28F 13/12; F28F 13/125; F28F 2250/02; F28D 7/1615
See application file for complete search history.

(56) References Cited

U.S. PATENT DOCUMENTS

| | | | | |
|---|---|---|---|---|
| 4,524,823 | A * | 6/1985 | Hummel | F28F 9/028 165/174 |
| 5,375,653 | A * | 12/1994 | Borlinghaus | F28F 13/12 165/109.1 |
| 7,806,171 | B2 * | 10/2010 | Taras | F28F 9/028 165/163 |
| 8,661,783 | B2 * | 3/2014 | Foster | F28F 9/026 165/109.1 |
| 9,249,730 | B2 | 2/2016 | Bourassa et al. | |
| 9,297,391 | B2 | 3/2016 | Rued et al. | |
| 2003/0010483 | A1 * | 1/2003 | Ikezaki | F28F 9/0273 165/174 |

(Continued)

FOREIGN PATENT DOCUMENTS

| | | | |
|---|---|---|---|
| DE | 102005042314 | A1 | 3/2007 |
| DE | 102005042315 | A1 | 3/2007 |

(Continued)

OTHER PUBLICATIONS

Extended European Search Report for International Application No. 16193635.6 filed Oct. 13, 2016, 7 pages.

*Primary Examiner* — Christopher R Zerphey
*Assistant Examiner* — Hans E Weiland
(74) *Attorney, Agent, or Firm* — Cantor Colburn LLP

(57) ABSTRACT

A heat exchanger comprises a conduit defining an inlet flow path for a fluid; a heat exchanger matrix disposed to receive a flow from the inlet flow path; and a swirler disposed within the conduit and arranged to improve dispersion of a flow from the inlet flow path over the heat exchanger matrix.

11 Claims, 11 Drawing Sheets

(56) References Cited

U.S. PATENT DOCUMENTS

| | | | | |
|---|---|---|---|---|
| 2008/0245502 | A1* | 10/2008 | Knaus | F28F 9/0265 165/42 |
| 2010/0089559 | A1* | 4/2010 | Gorbounov | F28F 9/028 165/174 |
| 2014/0020864 | A1* | 1/2014 | Wick | F28F 9/0263 165/96 |
| 2016/0231068 | A1* | 8/2016 | Schmitz | F28F 9/0265 |
| 2016/0273847 | A1* | 9/2016 | Rusich | F28F 9/028 |

FOREIGN PATENT DOCUMENTS

| | | | |
|---|---|---|---|
| DE | 102012000146 | A1 | 7/2013 |
| DE | 102014202447 | A1 | 8/2015 |

* cited by examiner

HEAT EXCHANGER

FOREIGN PRIORITY

This application claims priority to European Patent Application No. 16193635.6 filed Oct. 13, 2016, the entire contents of which is incorporated herein by reference.

TECHNICAL FIELD

The invention relates to a heat exchanger, particularly to a heat exchanger comprising a swirler.

BACKGROUND

Heat exchangers typically comprise a conduit for providing fluid to a heat exchanger matrix. Fluid disperses from the conduit through a flow distributor tank and then through the heat exchanger matrix in order to exchange heat therewith. The heat exchanger matrix typically comprises a larger volume than the conduit. Another fluid may be in thermal communication with the heat exchanger matrix and hence with the fluid from the conduit, in order to exchange heat with the fluid from the conduit.

Typically, the conduit and heat exchanger matrix are sized suitably for their intended purpose, ensuring that fluid flowing out of the conduit and through the heat exchanger matrix travels sufficiently slowly to disperse throughout the heat exchanger matrix volume.

SUMMARY

According to a first aspect of the present invention there is provided a heat exchanger comprising a conduit defining an inlet flow path for a fluid; a heat exchanger matrix disposed to receive a flow from the inlet flow path; and a swirler disposed within the conduit and arranged to improve dispersion of a flow from the inlet flow path over the heat exchanger matrix.

Typically, conduits for heat exchangers are sized sufficiently large to allow fluid flowing therethrough to be slow enough to diffuse evenly when leaving the conduit so as to disperse over and through the heat exchanger matrix, thereby increasing the contact area of the fluid with the heat exchanger matrix. An open tank can be sufficient to distribute the flow evenly with this slow flow speed. However, some heat exchangers may require the conduit to be narrow, or narrower than is typical or desired for efficient heat transfer. In this case the fluid may flow at higher speeds, and may not diffuse sufficiently when exiting the conduit and entering the heat exchanger matrix for efficient heat transfer therefrom. The conduit may therefore be arranged to receive high speed and/or high volumes of fluid flow, and design constraints may not permit widening of the conduit to decrease the fluid flow speed. Hence, a swirler is provided in the conduit according to the present invention, and this may allow suitable distribution of the flow even for higher flow speeds.

Without a swirler, as fluid flow speed increases, fluid flow from a conduit becomes increasingly focused on a single region of the heat exchanger matrix. This results in a localised hot spot in the heat exchanger matrix and inefficient heat transfer in the system. The hot spot can also cause expansion of the heat exchanger matrix, leading to deformation of the matrix and increased wear and degradation, micro-fractures, and leakage.

The provision of a swirler may improve the flow distribution from the fluid from the conduit over the heat exchanger matrix. The swirler may achieve this by modifying the flow distributing from the conduit to make the distribution more even over the heat exchanger matrix. The swirler may alternatively or additionally improve the flow distribution by redirecting flow such that an isolated hot spot is not generated near the centre of the heat exchanger matrix. Instead, flow can be directed to ensure that hotter regions form at or near the outer regions of the heat exchanger matrix, reducing the resulting deformation on the matrix caused by the heat.

The swirler may comprise a plurality of blades, for example blades with curved surfaces to change the fluid flow direction. The swirler may comprise two, three, four, or any suitable number of blades. The blades may evenly divide the flow path within the conduit into a plurality of parallel flow paths within the swirler. The blade may have approximately constant thickness, or may have varying thicknesses.

The swirler may be arranged to impart angular momentum to the fluid flow. The angular momentum may be a net angular momentum in a predetermined orientation. The plurality of blades may define a helical flow path within the conduit, or a plurality of helical flow paths adjacent one another.

The blades may be separated from each other by equal angles, such that they have equiangular spacing within the conduit. For example, for a swirler comprising four blades, the blades may be spaced at approximately 90 degrees to adjacent blades. Alternatively, the blades may be spaced with varying angles between adjacent blades.

The swirler may be disposed across the entire flow path. In this way, no unobstructed path exists for fluid to flow directly through the swirler. The swirler may obstruct direct flow of fluid along the flow path and redirect it according to the shape of the swirler.

The heat exchanger matrix may have a polygonal cross section in the direction of the flow path, and the swirler may be arranged to direct flow from the flow path towards each of the vertices of the polygonal cross section. The heat exchanger matrix may have a quadrilateral cross section in the direction of the flow path, and the swirler may comprise four blades arranged to direct flow from the flow path towards each of the four corners of the cross section. The swirler may thereby be arranged to distribute fluid across substantially an entire cross section of the of the heat exchanger matrix.

The heat exchanger matrix may comprise an array of channels providing multiple flow paths for the fluid in heat exchange with another fluid, and the swirler may be arranged to disperse the flow from the inlet flow path across the array of channels. The array of channels may be approximately perpendicular to the fluid flow path.

The swirler may comprise a sleeve portion providing a friction fit within the conduit. For example, the conduit may have a circular cross section and the sleeve portion may be cylindrical, the outer diameter of the sleeve portion being slightly less than the inner diameter of the conduit so as to form a friction fit therebetween. The conduit may have a cross-section which is not circular, and the swirler may thereby be prevented from rotation within the conduit as a consequence of forces applied to the swirler from fluid flow.

The heat exchanger may be arranged to carry a fluid flow with a speed of greater than about 300 m/s via the conduit, and may be arranged to carry a fluid flow of greater than 500 m/s via the conduit.

The swirler may be disposed proximate an end of the conduit, and may be proximate the inlet flow path of the heat exchanger. The swirler may be disposed facing the heat exchanger matrix and there may be an open tank section of the heat exchanger between the swirler and the matrix. The fluid flow path between the conduit and heat exchanger matrix may be unobstructed but for the swirler.

The swirler may be arranged to provide a uniformity index of greater than 80% to the fluid flow dispersed therefrom. The swirler may be arranged to provide a uniformity index of greater than 81% to the fluid flow dispersed therefrom.

The swirler may be formed by additive manufacturing. The swirler may therefore comprise a fluid flow path, or a plurality of fluid flow paths, that would not be possible or would be difficult to manufacture using conventional methods. For example, the swirler comprising four blades may comprise a flow paths that winds helically around more than 90 degrees of a circle. Alternatively to additive manufacturing, the swirler may be formed with a stack of plates, for example in a laminated structure.

The heat exchanger may be for aerospace use. A second aspect of the invention provides an aircraft comprising a heat exchanger as described above with reference to the first aspect, and optionally including the optional features set out above.

According to a third aspect of the present invention there is provided a method for distributing flow in a heat exchanger as described above with reference to the first aspect; the method comprising: using the swirler to disperse the flow from the inlet flow path over the heat exchanger matrix. The method may include the use of a swirler and/or heat exchanger with any or all of the features discussed above.

BRIEF DESCRIPTION OF THE DRAWINGS

Certain exemplary embodiments of the invention will be described below by way of example only and with reference to the accompanying drawings in which.

DETAILED DESCRIPTION

Figure 1:
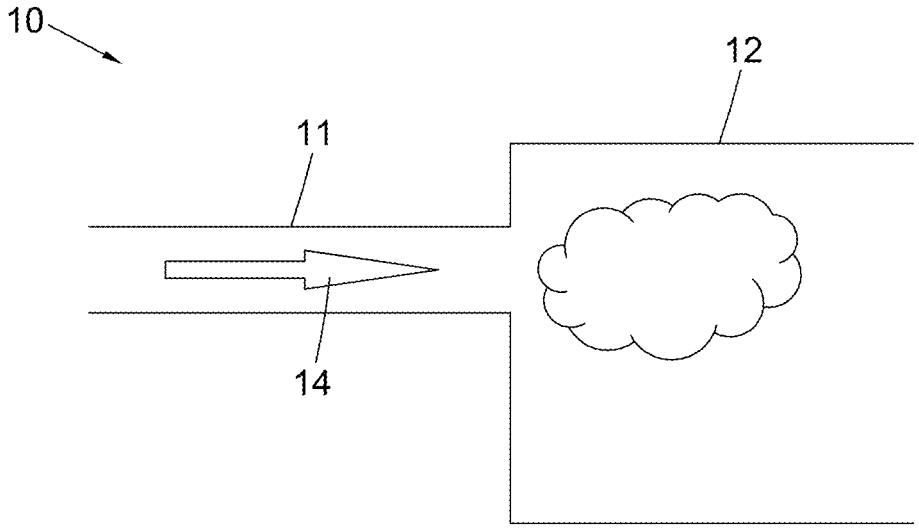
Fig. 1 Prior Art
FIG. 1 shows a schematic of a heat exchanger according to the prior art.

FIG. 1 shows a typical heat exchanger 10, comprising a conduit 11 and a heat exchanger matrix 12. Fluid 14 flows through the conduit 11 into a volume defined by the tank of the heat exchanger 12 and disperses throughout the volume.

Figure 2:
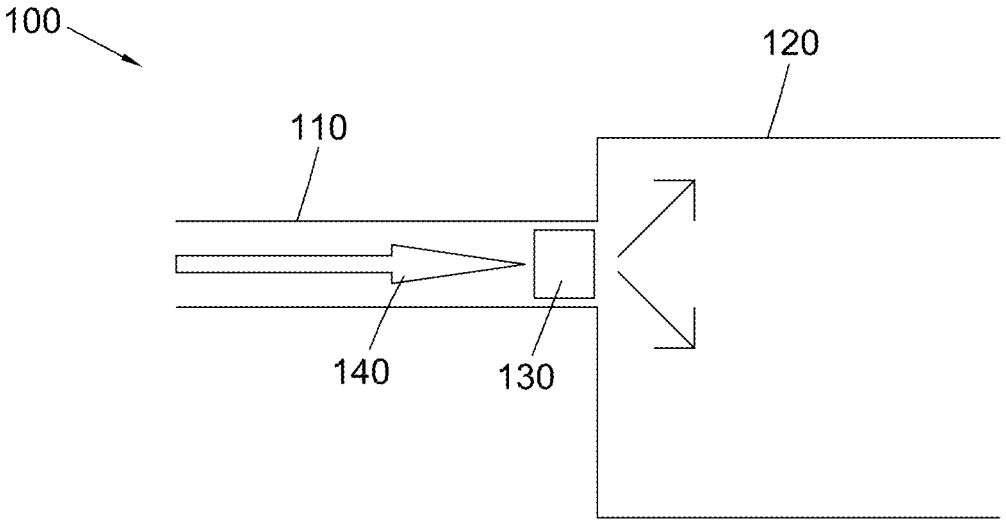
FIG. 2 shows a schematic of a heat exchanger with a swirler.

FIG. 2 shows a heat exchanger 100 comprising a conduit 110, a heat exchanger matrix 120, and a swirler 130. Fluid 140 flows along the conduit 110 at a higher speed than is usual for heat exchangers. The fluid 140 then flows through the swirler 130 and is dispersed thereby into a volume defined by the heat exchanger matrix 120.

Figure 3A:
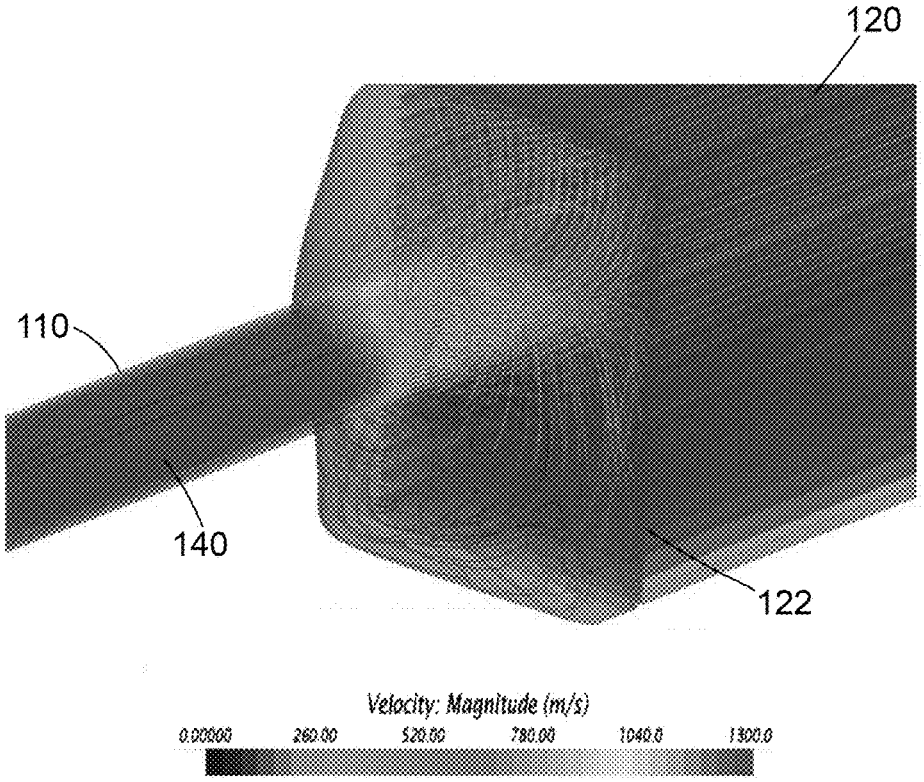
Fig. 3A Prior Art
FIG. 3A shows a plot of fluid flow intensity in a heat exchanger.

FIG. 3A shows the speed of fluid in a heat exchanger without a swirler. Fluid 140 flows along conduit 110 at speeds of more than 1000 m/s, up to speeds of 1300 m/s. Fluid 140 reaching the volume of the heat exchanger matrix 120 disperses into the volume, over channels 122 of the heat exchanger matrix 120. The channels 122 may carry a second fluid (not shows) so as to be in heat exchange with the first fluid 140.

Figure 3B:
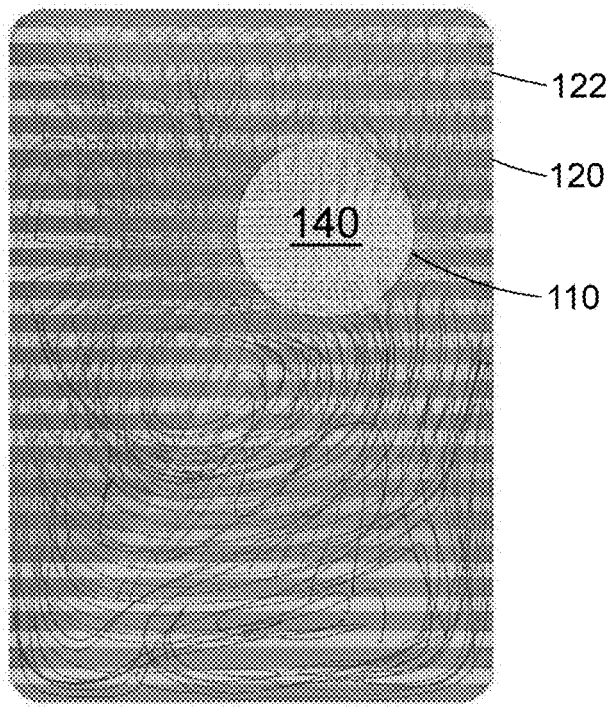
Fig. 3B Prior Art
FIG. 3B shows an alternative view of the plot of fluid flow intensity of FIG. 3A.

FIG. 3B shows an end-on view of the heat exchanger 100 of FIG. 3A. The channels 122 run horizontally, substantially perpendicular to the flow path of fluid 140 so as to maximise contact therewith. Dispersal of the fluid 140 into the volume defined by the heat exchanger matrix 120 is indicated by the flow lines.

Figure 3C:
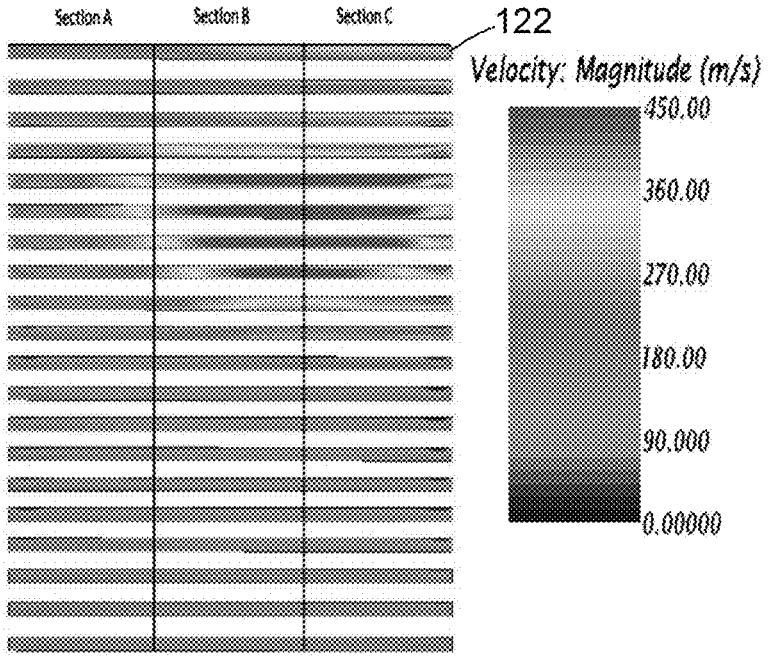
Fig. 3C Prior Art
FIG. 3C shows a cross-section of the plot of fluid flow intensity of FIGS. 3A and 3B over a plurality of channels.
Figure 3D:
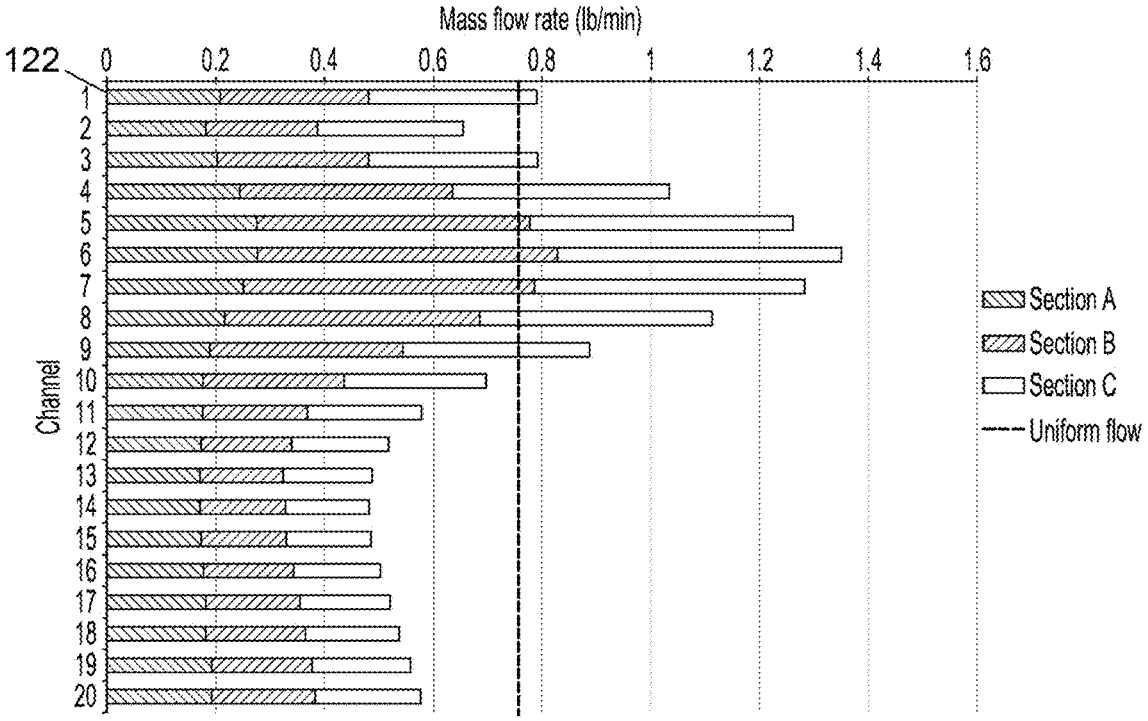
Fig. 3D Prior Art
FIG. 3D shows a distribution of mass flow rate of fluid for the plurality of channels of FIG. 3C.

FIGS. 3C and 3D show the magnitude of the speed of the fluid 140 distributed across the channels 122. Without a swirler, the distribution is focussed in a localised region, such that high velocity fluid 140 impinges on the channels primarily in one place within the heat exchanger matrix 120. This causes thermal expansion of the channels 122 in the region of the focus, resulting in fatigue of the matrix 120, and leading to micro-fractures and leakages.

FIGS. 4A to 4D show analogous plots to those of FIGS. 3A to 3D but for a heat exchanger 100 which includes a swirler 130. FIG. 4E shows a perspective view of the swirler 130 for the embodiment of FIG. 4.

The swirler 130 comprises four blades 132 in a right-handed spiral, spaced equidistantly about the axis of the conduit 110. Each of the blades 132 sweeps 90 degrees about the axis of the conduit 110, so that the swirler 130 covers an entire cross section of the conduit 110. The swirler 130 is rotated within the conduit 110 relative to the heat exchanger matrix 120 so that the end of one of the blades is at an angle of 22.5 degrees to the side of the heat exchanger matrix 120.

The fluid 140 is directed by the swirler 130 in four adjacent helical fluid paths within the conduit 110. Upon leaving the swirler 130 and entering the heat exchanger matrix 120, the angular momentum imparted to the fluid by the swirler 130 carries the fluid in four diverging streams outward from the axis of the conduit 110. The alignment of the swirler 130 within the conduit 110, directs each of these four streams respectively approximately towards each of the four corners of the heat exchanger matrix 120. These streams are clearly visible in FIG. 4B.

Figure 4A:
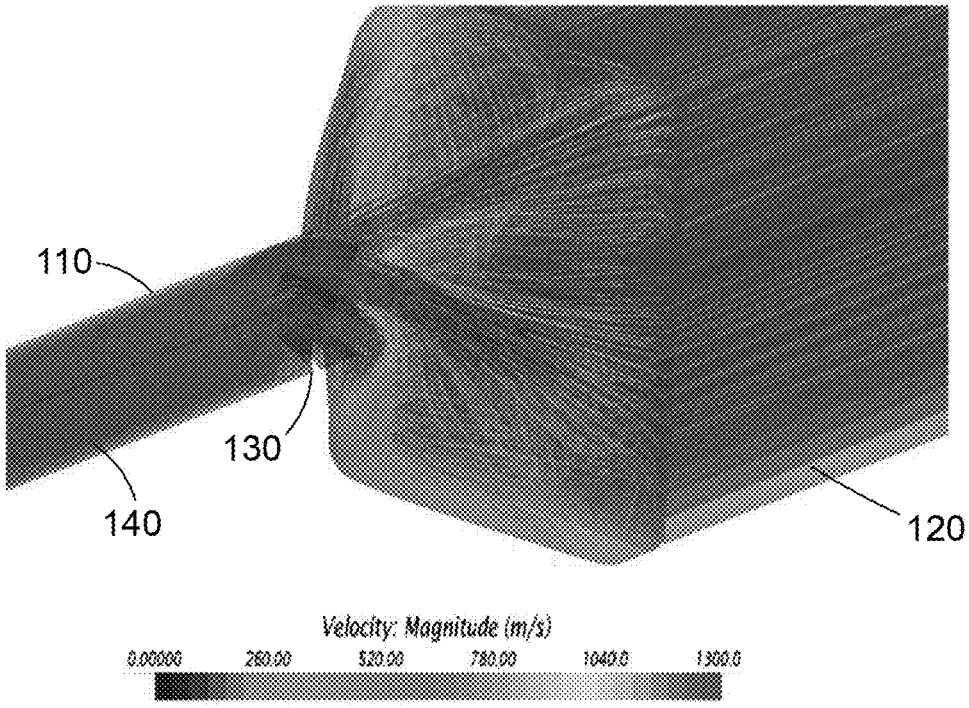
FIG. 4A shows a plot of fluid flow intensity in a heat exchanger with a swirler.
Figure 4B:
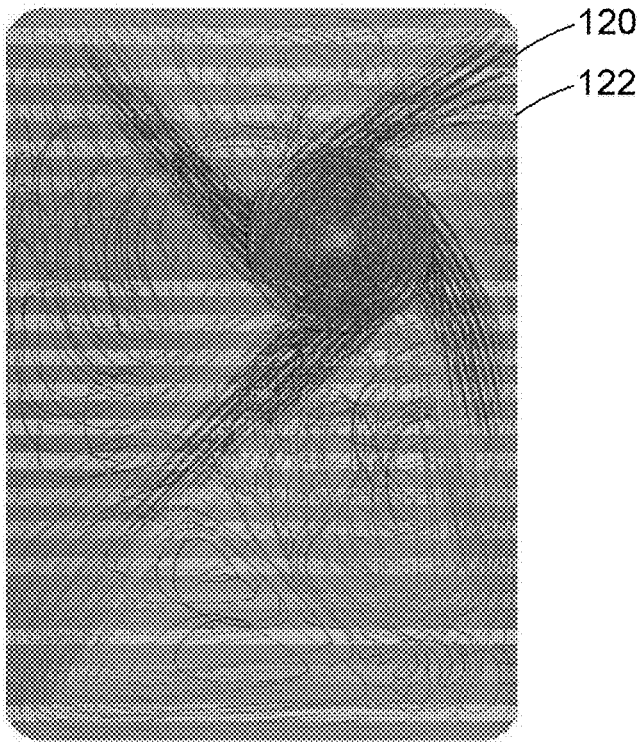
FIG. 4B shows an alternative view of the plot of fluid flow intensity of FIG. 4A.
Figure 4C:
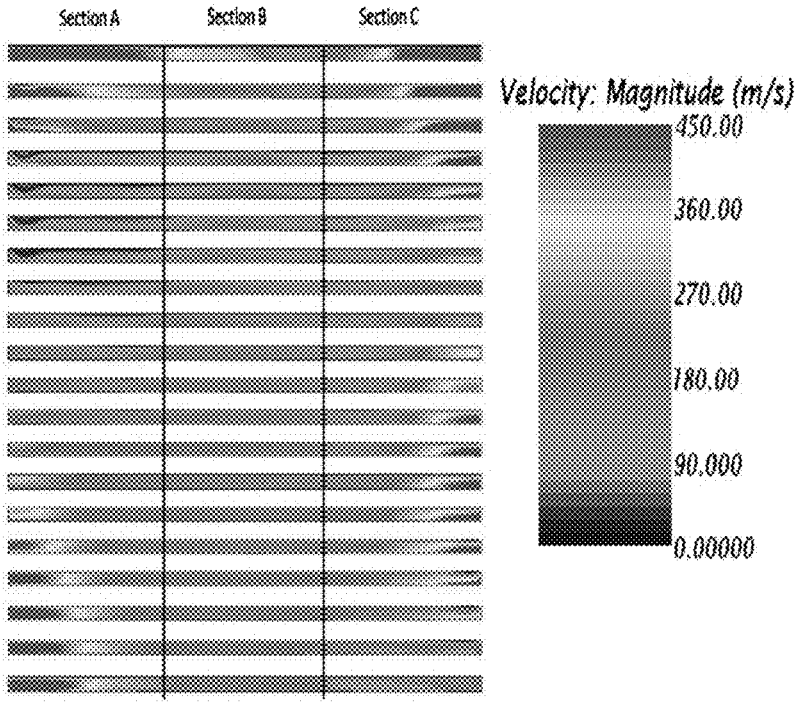
FIG. 4C shows a cross-section of the plot of fluid flow intensity of FIGS. 4A and 4B over a plurality of channels.

FIG. 4C shows that the highest fluid velocities are thus disposed approximately in each of the four corners of the heat exchanger matrix 120. The heat exchanger matrix 120 thus experiences less thermal expansion and fatigue in the centre of the matrix 120. Instead, a greater proportion of the thermal expansion and fatigue is applied near the edges of the matrix, where the heat exchanger is better able to withstand the resultant stresses.

Figure 4D:
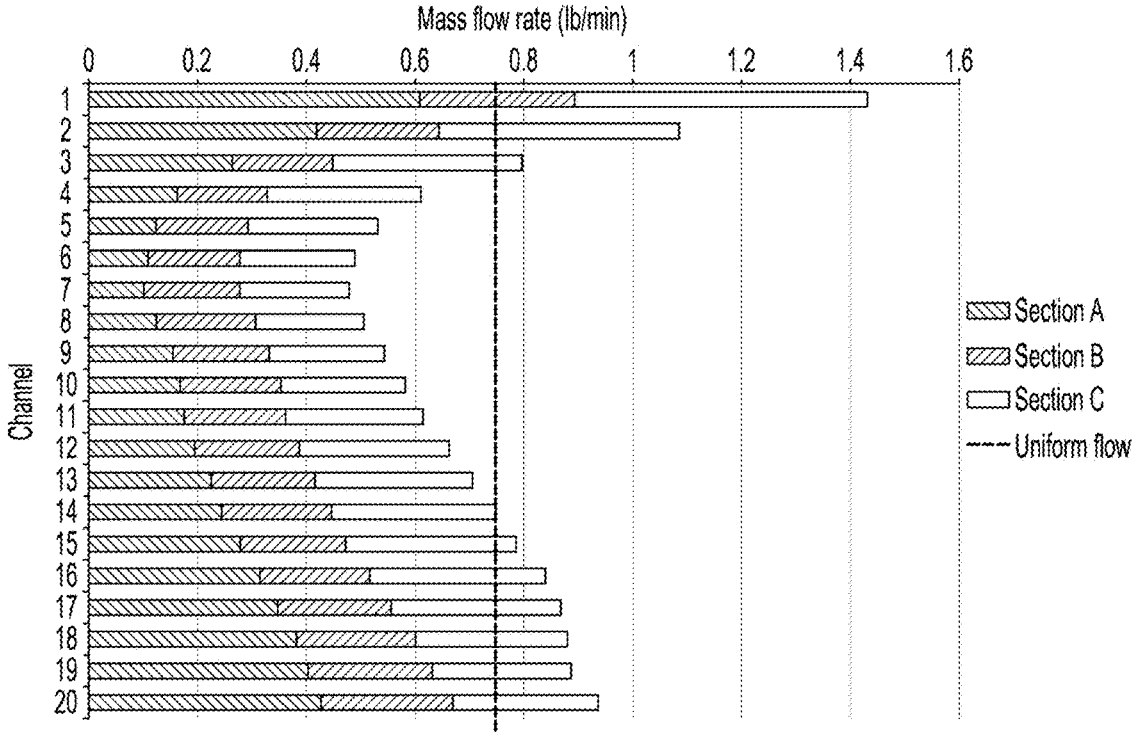
FIG. 4D shows a distribution of mass flow rate of fluid for the plurality of channels of FIG. 4C.
Figure 4E:
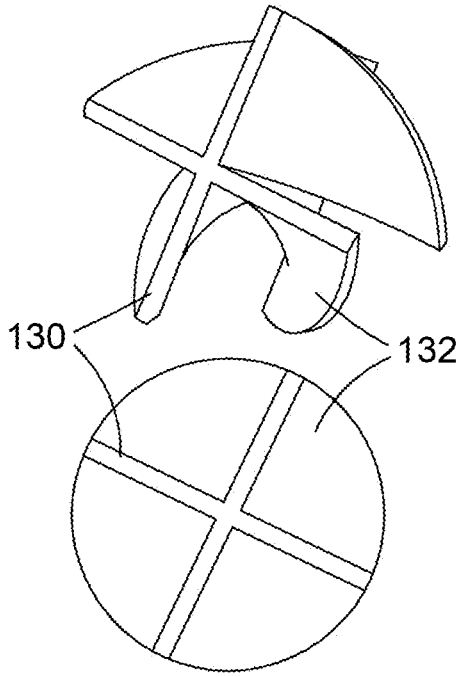
FIG. 4E shows views of swirler.

FIG. 4D shows the distribution of the fluid speeds across the channels 122, from the top to the bottom of the heat exchanger 120. A fully uniform flow is in indicated by the dashed black line. The uniformity index for the swirler 130 of FIG. 4E is 80.38%, compared to that of 79.05% for the heat exchanger 100 without a swirler.

The uniformity index (UI) is a measure of how evenly the flow is distributed e.g. across a heat exchanger matrix face. It is calculated as a fraction and quoted as a percentage, with 100% representing perfectly uniform mass flow distribution. A value for the uniformity index may be calculated by dividing the face of the heat exchanger matrix into cells, finding a sum over all of the cells of the differences between a cell velocity and the average velocity, and dividing this sum of differences by the average velocity over all of the cells which make up the heat exchanger matrix face. The uniformity index may then be calculated using the expression:

$$\text{Uniformity index} = 1 - \frac{\sum_f |\phi_f - \overline{\phi}| A_f}{2|\overline{\phi}| \sum_f A_f}$$

where $\phi_f$ is the velocity value of a cell, $\overline{\phi}$ is the average velocity, and $A_f$ is the area of a cell of the heat exchanger matrix face.

Figure 5:
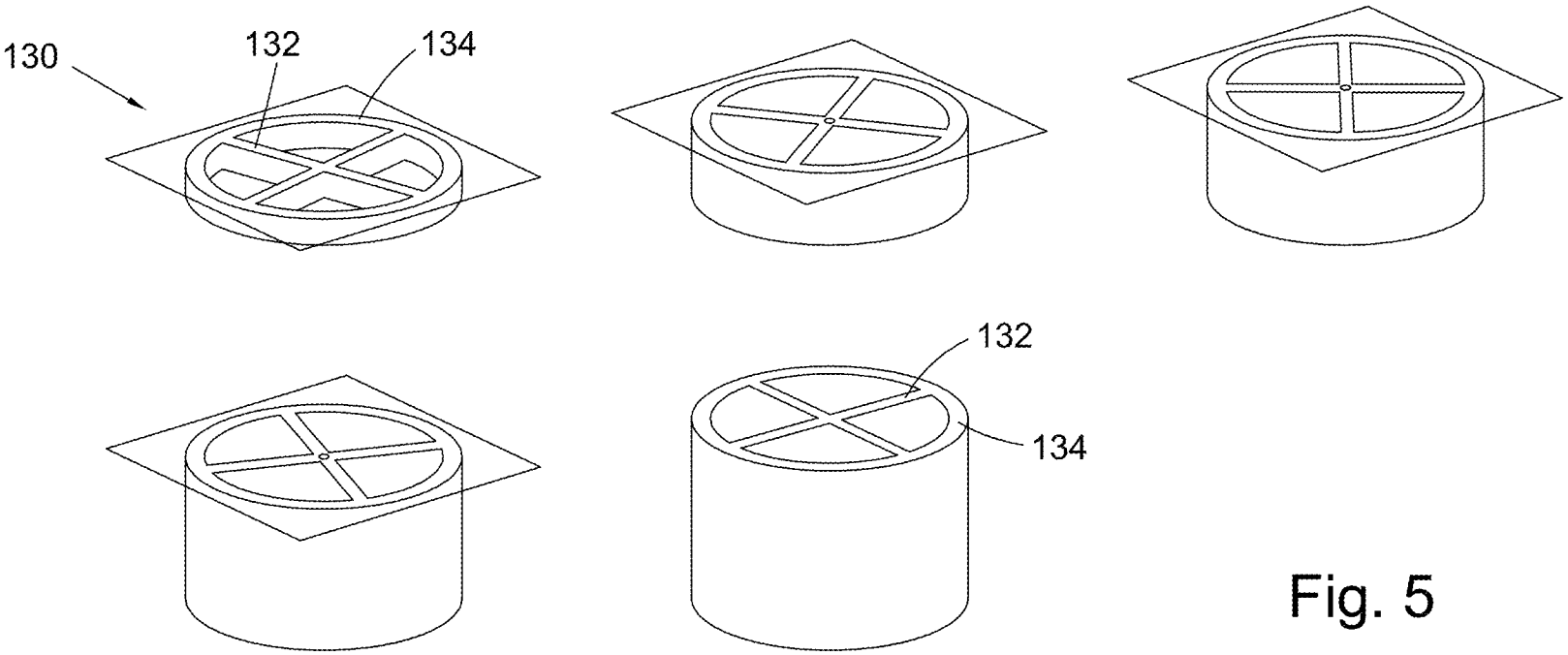
FIG. 5 shows a swirler at various stages of manufacture by additive manufacturing.

FIG. 5 shows a swirler 130 in various stages of production by an additive manufacturing process. The swirler 130 comprises four blades 132 and a sleeve portion 134 surrounding the blades. The swirler 130 is formed by the addition of incremental layers, defining the blades 132 and sleeve portion 134. The completed swirler 130 may be made to the desired dimensions retrofit to existing heat exchanger conduits 110 to improve the flow distribution of fluid therefrom during use.

Figure 6:
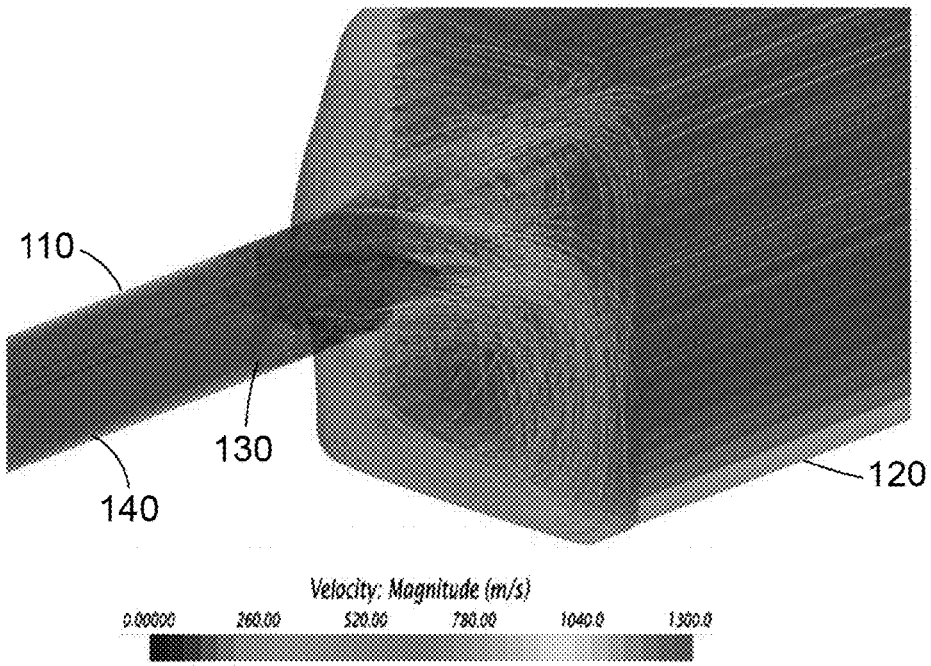
FIG. 6 shows plots analogous to those of FIGS. 4A to 4E but for an alternative swirler.
Figure 6:
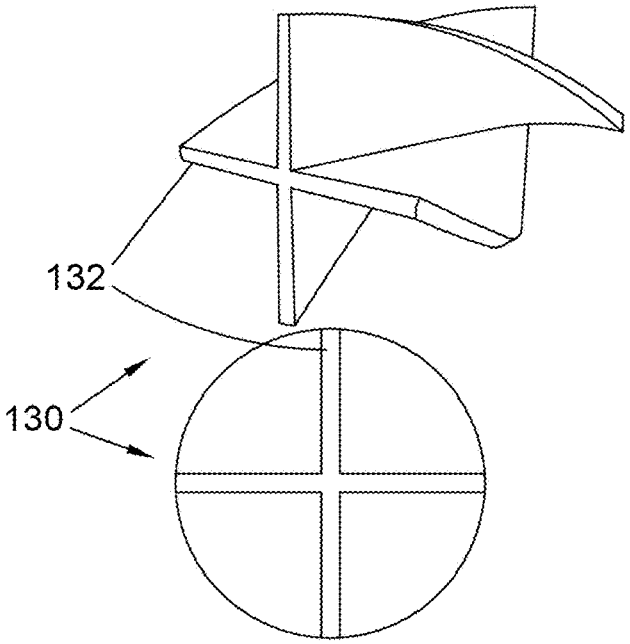
Figure 6:
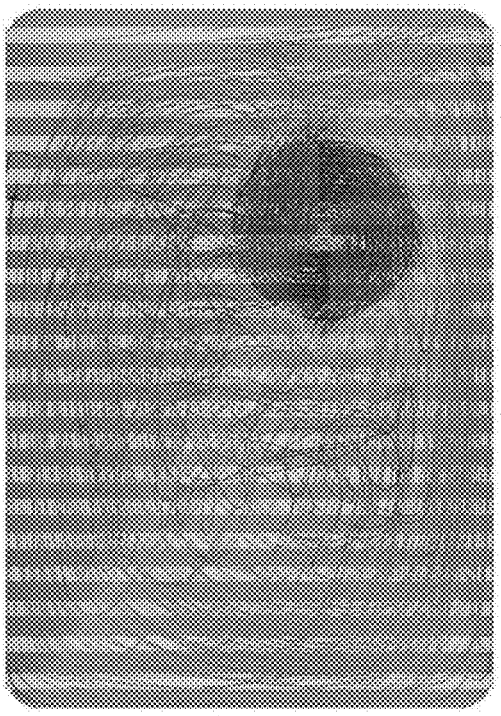
Figure 6:
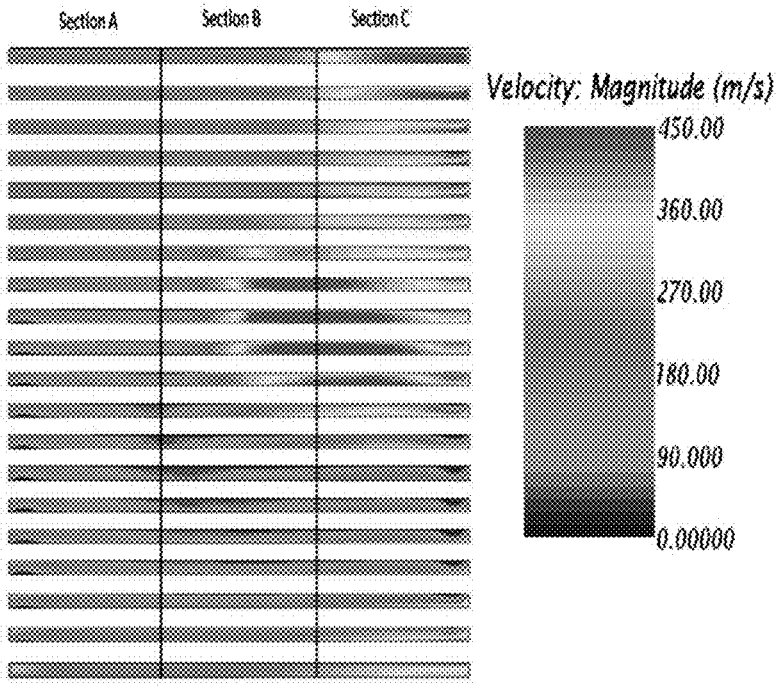
Figure 6:
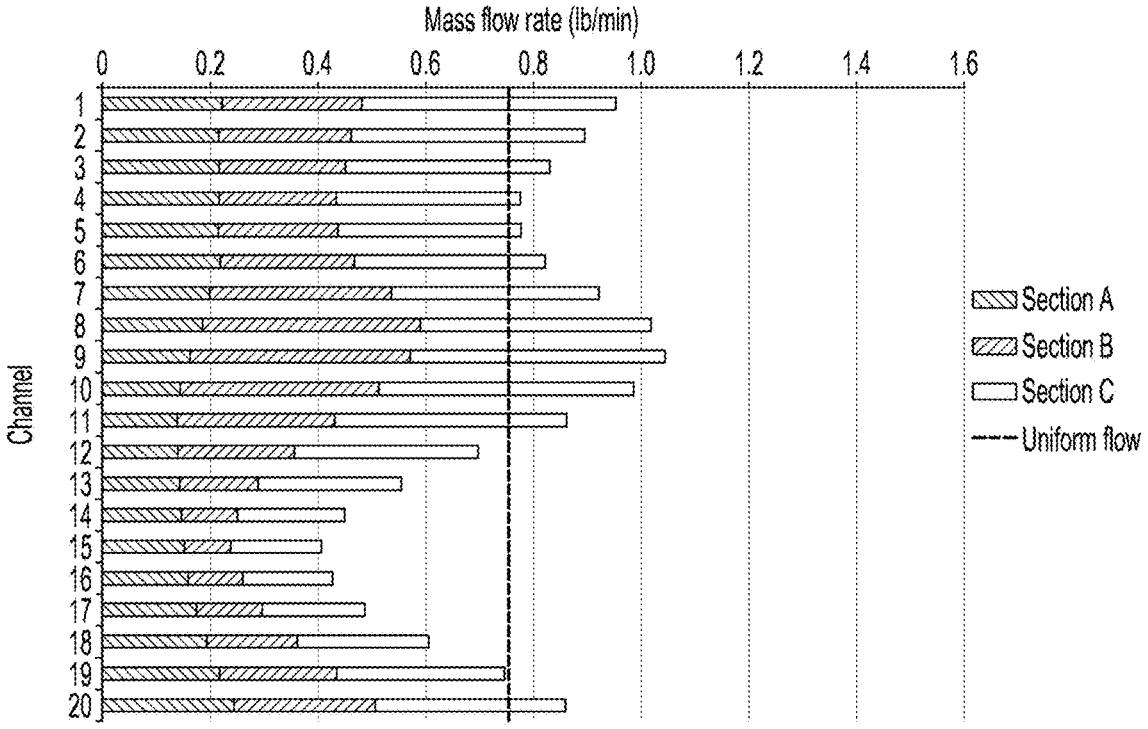

FIG. 6 shows plots corresponding to those of FIGS. 3 and 4, for a swirler 130 with four blades 132 sweeping a 90 degree angle. The swirler 130 of FIG. 6 has an increased length along the conduit 110 compared to the swirler of FIG. 4. The swirler 130 is also aligned with the heat exchanger matrix 120 so that the ends of the blades are vertical and horizontal.

The increased length of the swirler 130 prevents the four streams entering the volume of the heat exchanger matrix 120 from diverging as much as the four streams formed by the swirler 130 of FIG. 4. The velocity of the fluid 140 is then distributed in a hot spot but also across a corner of matrix 120. The uniformity index is increased to 79.31%.

Figure 7:
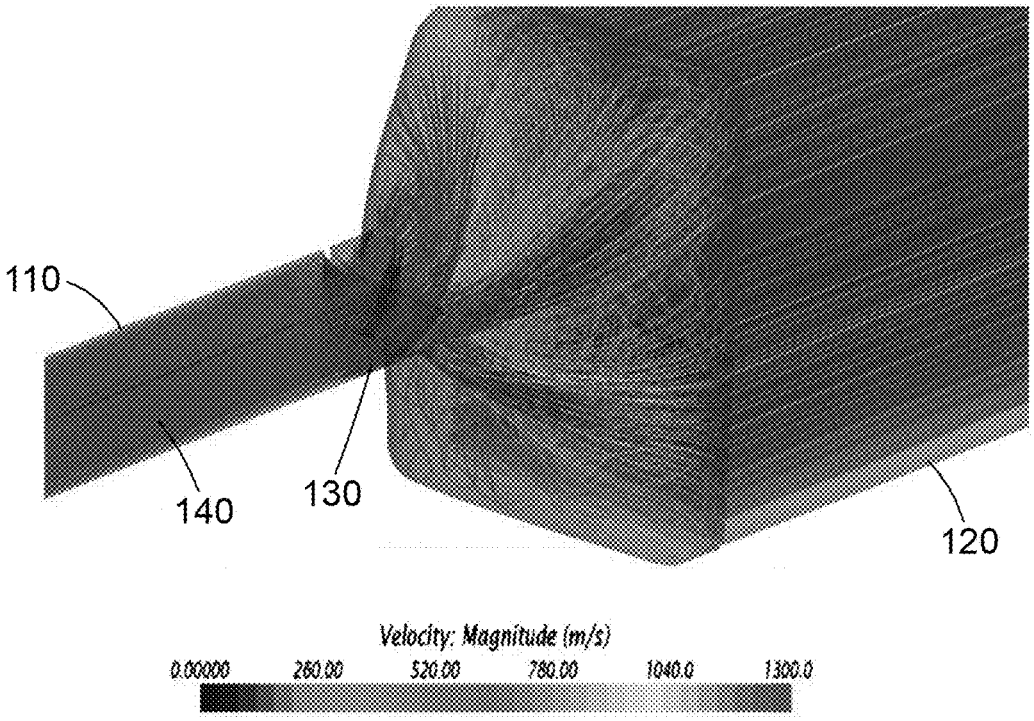
FIG. 7 shows plots analogous to those of FIGS. 4A to 4E but for another alternative swirler.
Figure 7:
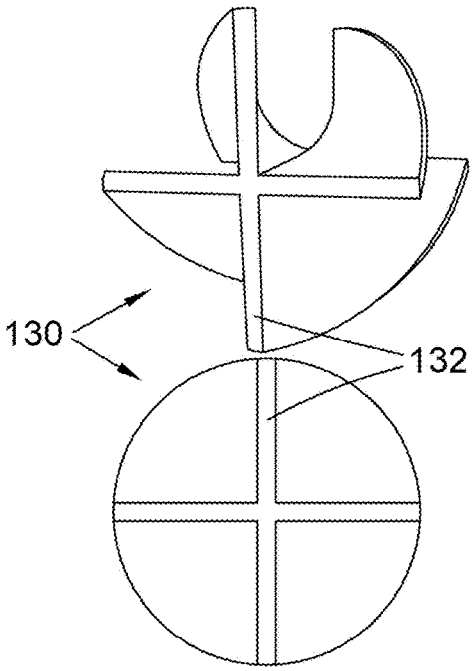
Figure 7:
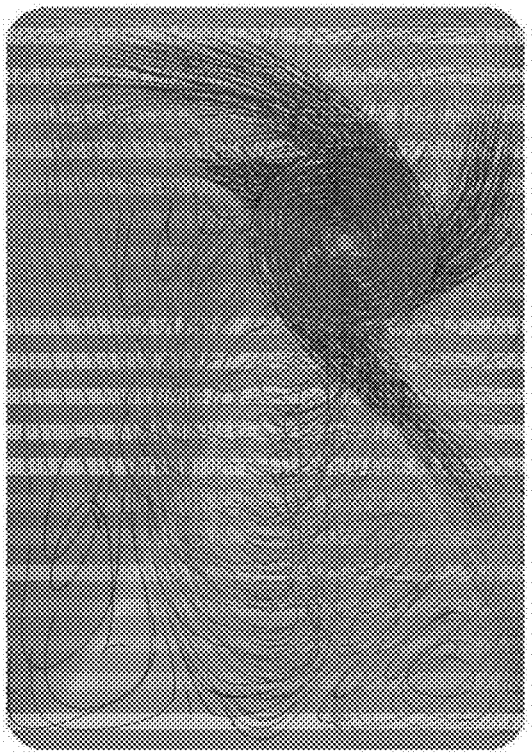
Figure 7:
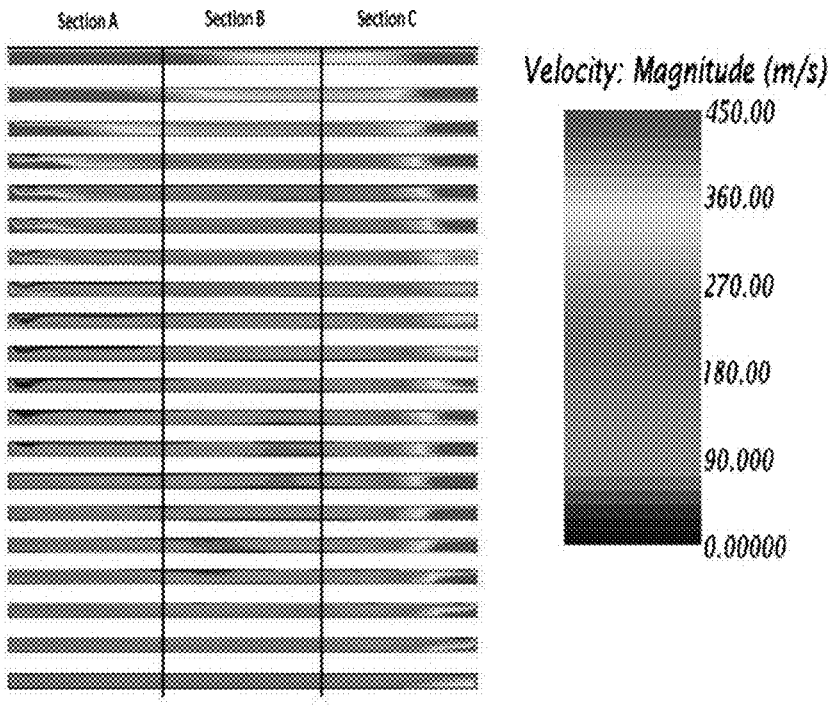
Figure 7:
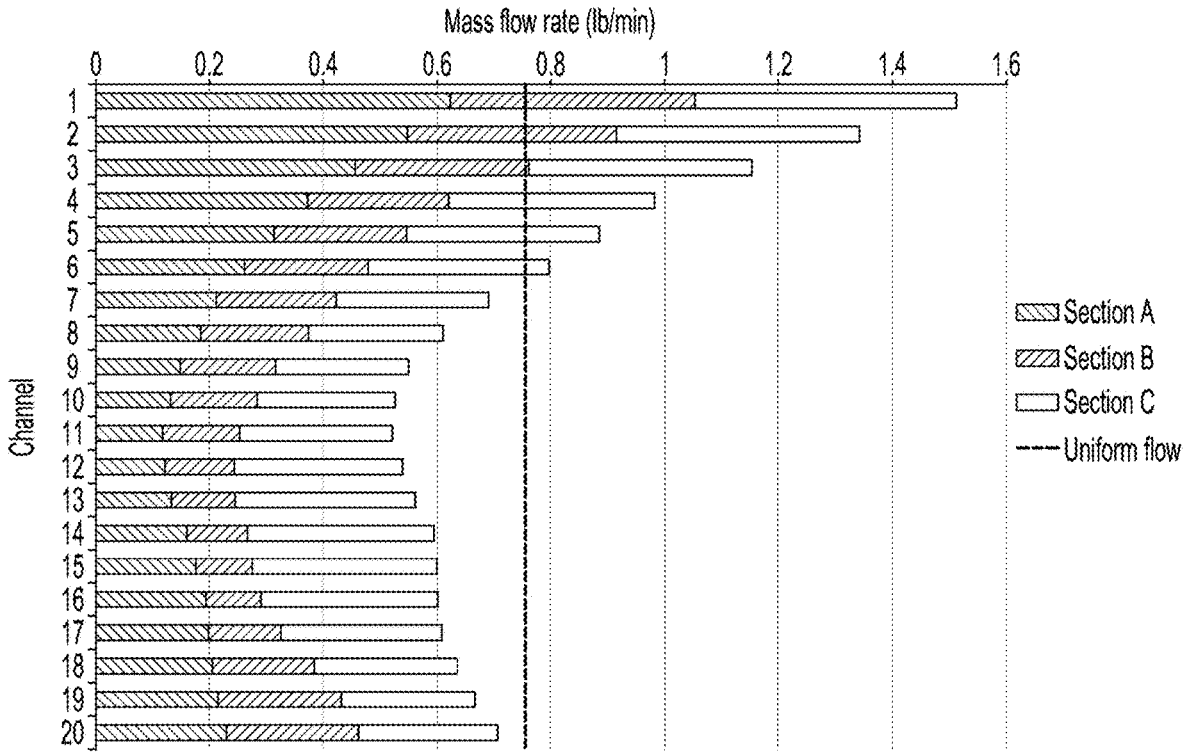

FIG. 7 shows corresponding plots to those of FIGS. 3, 4 and 6, but for an alternative swirler 130, comprising four blades 132 with a 90 degree sweep in a left-handed helical orientation. The ends of the blades 132 are aligned vertically and horizontally with the heat exchanger matrix 120.

The swirler 130 of FIG. 6 is the same length in the conduit 110 as the swirler 130 of FIG. 4, and consequently the four streams of fluid 140 entering the matrix 120 diverge more than those of FIG. 6. Although the uniformity index of the embodiment of FIG. 7 is only 77.00%, the flow distribution is improved since it is spread around the edges of the matrix 120, avoiding a single central hot spot.

The alignment of the swirler 130 within the conduit 110 with the heat exchanger matrix 120 will affect the resulting distribution of the fluid 140 over the matrix 120. The position of the conduit 110 relative to the heat exchanger 120 will also affect the final distribution. It may therefore be advantageous to align the swirler 130 so that the resulting streams are distributed approximately evenly over a cross-section of the heat exchanger 120, for example by directing the streams to the corners of the heat exchanger 120.

The invention claimed is:

1. A heat exchanger comprising:

a conduit defining an inlet flow path for a fluid;

a heat exchanger matrix disposed to receive a flow from the inlet flow path; and a swirler disposed within the conduit and arranged to improve dispersion of a flow from the inlet flow path over the heat exchanger matrix;

wherein the heat exchanger matrix has a polygonal cross section in the direction of the flow path, and wherein the swirler is arranged to direct flow streams from the flow path towards each of the corners of the polygonal cross section;

wherein the swirler comprises a plurality of blades; and wherein the blades wind helically around more than 90 degrees and are disposed across an entire cross-section of the flow path so that no unobstructed path exists for fluid flow directly through the swirler along the conduit.

2. A heat exchanger as claimed in claim 1, wherein the plurality of blades define a helical flow path within the conduit.

3. A heat exchanger as claimed in claim 1, wherein the blades are separated from each other by equal angles.

4. A heat exchanger as claimed in claim 1, wherein the heat exchanger matrix has a quadrilateral cross section in the direction of the flow path, and wherein the swirler comprises four blades arranged to direct flow from the flow path towards each of the four corners of the cross section.

5. A heat exchanger as claimed in claim 1, wherein the heat exchanger matrix comprises an array of channels providing multiple flow paths for the fluid in heat exchange with another fluid, and the swirler is arranged to disperse the flow from the inlet flow path across the array of channels.

6. A heat exchanger as claimed in claim 1, wherein the swirler comprises a sleeve portion providing a friction fit within the conduit.

7. A heat exchanger as claimed in claim 1, wherein the heat exchanger is arranged to carry a fluid flow with a speed of greater than 300 m/s via the conduit.

8. A heat exchanger as claimed in claim 1, wherein the swirler is disposed proximate an end of the conduit.

9. A heat exchanger as claimed in claim 1, wherein the swirler has been formed by additive manufacturing.

10. An aircraft in combination with a heat exchanger as claimed in claim 1.

11. A method for distributing flow in a heat exchanger that includes a conduit defining an inlet flow path for a fluid, a heat exchanger matrix disposed to receive a flow from the inlet flow path, and a swirler disposed within the conduit and arranged to improve dispersion of a flow from the inlet flow path over the heat exchanger matrix, the method comprising:

using the swirler to disperse the flow from the inlet flow path over the heat exchanger matrix, wherein the heat exchanger matrix has a polygonal cross section in the direction of the flow path, and wherein using the swirler includes directing flow streams from the flow path towards each of the corners of the polygonal cross section and wherein the swirler comprises a plurality of blades and wherein wind helically around more than 90 degrees and are disposed across an entire cross-section of the flow path so that no unobstructed path exists for fluid flow directly through the swirler along the conduit.

* * * * *